US007247797B2

(12) United States Patent
Büthe et al.

(10) Patent No.: US 7,247,797 B2
(45) Date of Patent: Jul. 24, 2007

(54) COMMUNICATION CABLE

(75) Inventors: Harald Büthe, Nettetal (DE); Harald Heymanns, Mönchengladbach (DE); Wilfried Konieczny, Ratingen (DE); Stefan Krumm, Neuss (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 11/295,132

(22) Filed: Dec. 5, 2005

(65) Prior Publication Data

US 2006/0180337 A1 Aug. 17, 2006

(30) Foreign Application Priority Data

Dec. 6, 2004 (DE) ..... 10 2004 058 845

(51) Int. Cl.
*H01B 7/00* (2006.01)

(52) U.S. Cl. ..... 174/110 R; 174/113 R; 174/120 R; 174/121 R

(58) Field of Classification Search ..... 174/110 R, 174/113 R, 120 R, 121 R, 121 A, 121 AR, 174/121 SR, 122 R, 122 G, 120 AR, 120 SR, 174/124 R, 124 G, 124 GC
See application file for complete search history.

(56) References Cited

U.S. PATENT DOCUMENTS 2,185,558 A * 1/1940 Lunsford ..... 174/116
3,576,388 A * 4/1971 Bruns ..... 174/116
3,692,924 A * 9/1972 Nye ..... 174/120 SR
3,823,255 A * 7/1974 La Gase et al. ..... 174/113 R
4,051,324 A * 9/1977 Anderson et al. ..... 174/121 R
4,150,249 A * 4/1979 Pedersen ..... 174/36
4,510,346 A * 4/1985 Bursh et al. ..... 174/36
4,510,348 A * 4/1985 Arroyo et al. ..... 174/121 A
4,547,626 A * 10/1985 Pedersen et al. ..... 174/107
4,659,871 A * 4/1987 Smith et al. ..... 174/113 R
5,012,045 A * 4/1991 Sato ..... 174/106 R
6,127,632 A * 10/2000 Oswald et al. ..... 174/120 R
6,787,694 B1 * 9/2004 Vexler et al. ..... 174/27

* cited by examiner

*Primary Examiner*—William H. Mayo, III
(74) *Attorney, Agent, or Firm*—Sofer & Haron, LLP

(57) ABSTRACT

A communication cable (K) with a large number of conductor cores (2) includes insulated conductors in which the conductor cores (2) are stranded with one another to form stranded elements (1). A large number of the stranded conductor cores are combined in the cable core (8). The insulation of the conductors (3) includes an inner layer (4) of a flameproof insulating material and an outer layer (5), which includes a polyolefin. The outer layer of the insulation is produced by extrusion, and is permanently joined with the inner layer (4). A closed sheath (9) includes a metal strip applied over the cable core. The outer sheath (10) includes a non-combustible material applied over the inner sheath (9), with which it is adhesively bonded.

9 Claims, 2 Drawing Sheets

COMMUNICATION CABLE

RELATED APPLICATIONS

The present application is related to and claimed the benefit of priority from German Patent Application No. 102004058845.7, filed on Dec. 6, 2004, the entirety of which are incorporated herein by reference.

1. Field of the Invention

The invention concerns a communication cable with a large number of conductor cores consisting of insulated conductors, in which the conductor cores are stranded with one another to form stranded elements, a large number of which are combined in a cable core, and in which the cable core is surrounded by at least one sheath of insulating material.

2. Background of the Invention

Communication cables of this type—hereinafter referred to simply as "cables"—have long been known and are used worldwide. They are described, for example, in the technical book "Kabeltechnik" [*Cable Engineering*] by M. Klein, Springer Verlag 1929, pp. 224-226. Under ordinary circumstances, the cables satisfy all transmission requirements and all mechanical requirements. However, when cables are to be provided with emergency operating properties and must maintain their insulating properties in case of fire, suitable insulating materials and insulating techniques must be used, and in many cases added features must be provided. Suitable measures of this type can result in deterioration of the transmission properties of the cable.

OBJECTS AND SUMMARY OF THE INVENTION

The objective of the invention is to design a cable of the type described above in such a way that, in case of fire, it satisfies all requirements that are placed on it for safety reasons and at the same time maintains its good transmission properties unchanged.

In accordance with the invention, this objective is achieved

- by providing that the insulation of the conductors consists of an inner layer of a flameproof insulating material and an outer layer, which consists of a polyolefin, is produced by extrusion, and is permanently joined with the inner layer,
- by applying a closed sheath that consists of a metal strip over the cable core, and
- by applying the outer sheath, which consists of a noncombustible material, over said closed inner sheath, with which it is adhesively bonded.

Noncombustible or flame-resistant and/or flameproof materials are used as insulating materials in this cable. The cable is thus noncombustible as a whole, so that it can be used to advantage, for example, in tunnels or other areas with an increased risk in the event of fire. In addition, the conductors of the conductor cores are enclosed by flameproof insulating material in the inner layer. This insulating material maintains its insulating properties in case of fire, even at high temperatures, at least for a sufficiently long time, so that the ability of the cable to function properly during this period of time is guaranteed (emergency operating behavior). In addition, it is advantageous for all insulating materials of the cable to be selected in such a way that their electrical properties allow optimum transmission of communication signals. This applies especially to the inner layer that directly surrounds the conductors of the conductor cores. For example, a material such as glass/silicone/mica, glass fibers, and/or ceramic fibers can be used for the inner layer. The outer layer that surrounds the inner layer consists of a polyolefin, whose good electrical properties are well known. Therefore, in addition to the improved safety of the cable in case of fire, its good electrical properties are also guaranteed, so that a cable of this type, on the one hand, can be connected without problems with other cables, whose structure is designed only according to predetermined electrical and transmission criteria, and, on the other hand, is suitable for higher frequencies up to 1 MHz, as are needed for the transmission of current digital signals at high bit rates.

BRIEF DESCRIPTION OF THE DRAWINGS

Specific embodiments of the object of the invention are illustrated in the drawings.

DETAILED DESCRIPTION

Figure 1:
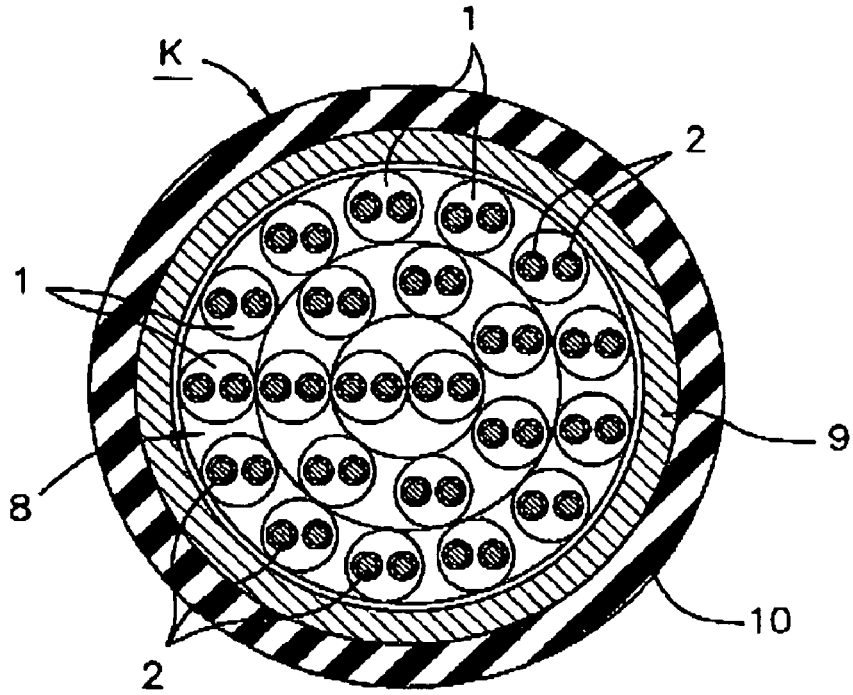
FIG. 1 shows a cross section of a cable of the invention.
Figure 2:
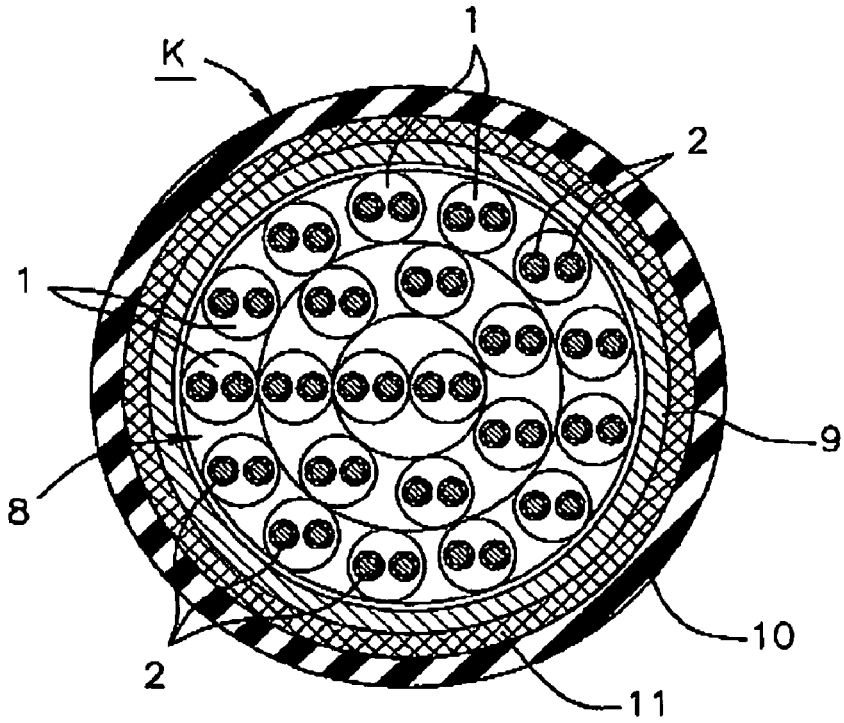
FIG. 2 shows a supplemented embodiment of the cable of FIG. 1.

The cable K shown in FIGS. 1 and 2 has stranded elements 1, which consist of two conductor cores 2 that are stranded together to form a pair. Instead of these pairs, star quads customarily used in the communications field could be used as stranded elements. In star quads, four conductor cores 2 are stranded together with precise coordination. In the illustrated embodiment, the stranded elements 1 are layer-stranded in the cable K in layers that lie one above the other. For the sake of clarity, gaps are shown between the stranded elements 1. These gaps are not actually present, because the stranded elements 1 lie directly next to one another. The stranded elements 1 can also be combined in bundles in the cable core instead of with the layer stranding shown in the drawings.

Figure 3:
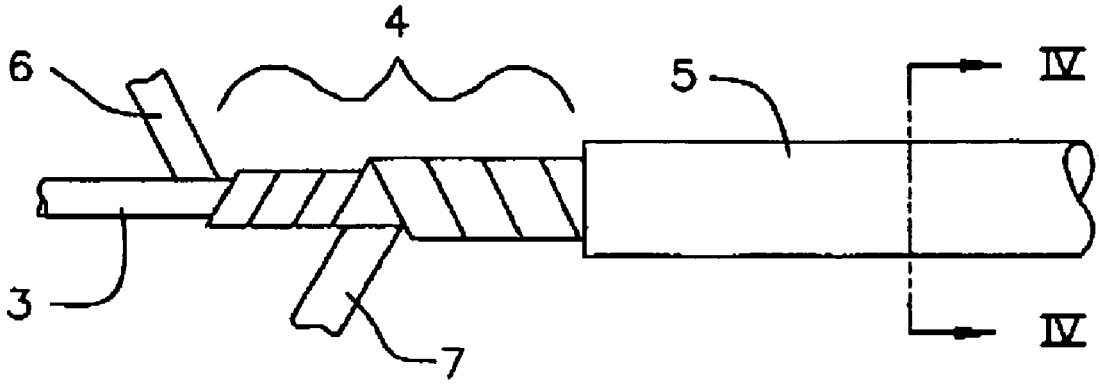
FIG. 3 shows an enlarged view of a conductor core that can be used in the cable, with layers removed in stages.
Figure 4:
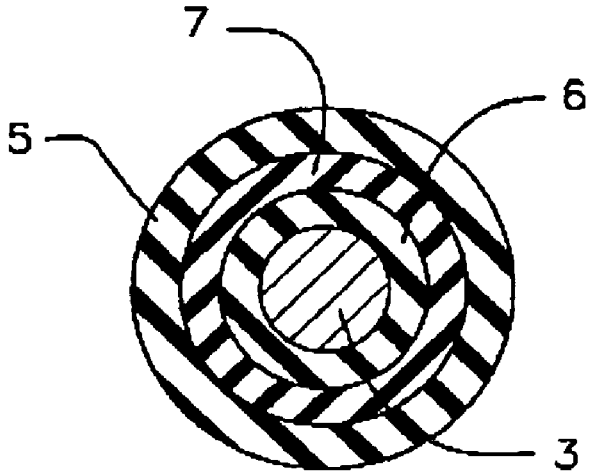
FIG. 4 shows a cross section through FIG. 3 along line IV-IV in a further enlarged view.

As shown in FIGS. 3 and 4, each conductor core 2 has a conductor 3, which is surrounded by an inner layer 4 of a flameproof insulating material. Examples of suitable insulating materials are a material based on glass/silicone/mica, which is also known by the commercial name "Mica", as well as materials that contain glass fibers and/or ceramic fibers. An extruded polyolefin layer 5, which can consist of polyethylene or of a halogen-free, flame-resistant mixture based on polyethylene, is applied over the inner layer 4.

The inner layer 4 has at least one strip that is wound around the conductor 3 with overlapping edges. In a preferred embodiment, this layer consists of two strips 6 and 7 that are wound around the conductor 3 with overlapping edges. The strips 6 and 7 are made of the materials specified above. In a preferred embodiment, they are wrapped around the conductor 3 in opposite directions, as shown in FIG. 3. In a preferred embodiment, the strips 6 and 7 have different widths. It is advantageous for the narrower strip 6, which directly surrounds the conductor 3, to be wrapped by the wider strip 7. The layer 5 is permanently joined with the inner layer 4, which, due to the wound strips, does not have a smooth surface. Therefore, the material of layer 5 can "interlock" with the inner layer during the extrusion process.

To produce the cable K in the illustrated embodiment, two conductor cores 2 are stranded together to form each pair of conductor cores. The conductor cores are preferably stranded with a complete (100%) backtwist. The resulting stranded elements 1 are then stranded, for example, in three layers that lie one above the other, likewise with complete backtwist, to form a cable core 8, as illustrated in FIGS. 1 and 2. The cable core 8 can also have more than three layers or only two layers. Wrappings can be applied between the individual layers of the stranded elements 1. The cable core 8 can also be surrounded by a wrapping. The stranded elements 1 can also be combined into bundles.

A closed sheath 9 consisting of metal strip is formed around the cable core 8. In a preferred embodiment, the metal strip runs in longitudinally and is wrapped around the cable core 8 with overlapping edges. It is advantageous for the overlap seam to be metallically closed. It is advantageous for the metal strip to be made of aluminum. For example, it can be realized as aluminum foil. The metal strip can be coated on one side with a copolymer coating that faces the outside in the finished cable and acts as an adhesion promoter, which becomes adhesive under the action of heat. The metal strip or sheath 9 is then adhesively bonded in a type of sandwich construction with an outer sheath 10 made of an insulating material, which is extruded onto the sheath 9. The adhesion is brought about by the heat of the extruded outer sheath 10. Adhesion between the sheath 9 and the outer sheath 10 can also be produced by applying an adhesion promoter to the sheath 9 before the outer sheath 10 is extruded.

In an advantageous refinement of the cable K, a layer of armor 11 can first be applied over the sheath 9, and then the outer sheath 10 can be applied on the armor 11, as shown in FIG. 2. In a preferred embodiment, the armor 11 consists of two steel strips, one above the other, each of which is wound with gaps. In this regard, it is advantageous for the gaps of each strip to be covered by the other steel strip.

The invention claimed is:

1. Communication cable comprising:

a plurality of conductor cores that are insulated conductors, in which the conductor cores are stranded with one another to form stranded elements, a plurality of which are combined in a cable core, and in which the cable core is surrounded by at least one sheath of insulating material, wherein the insulation of the conductors is an inner layer of a flameproof insulating material and an outer layer, which is made from a polyolefin, produced by extrusion, and adheres to the inner layer;

said inner layer includes two ribbons of flameproofing insulating material wound one above the other around said conductor with overlapping edges;

said extruded outer layer is formed of halogen-free, flame resistant material;

a closed inner sheath that is a metallic strip applied over the cable core which is coated one side with a copolymer that serves as an adhesion promoter;

said outer sheath, which is an noncombustible material, applied over the inner sheath, with which it is adhesively bonded and that the coated side of the metallic strip of the inner sheath faces the outer sheath in the finished cable so that the outer sheath is adhesively bonded to the inner sheath.

2. Cable in accordance with claim 1, wherein the two ribbons around said inner layer have different widths.

3. Cable in accordance with claim 2, wherein the two strips are wound around the conductor with different winding directions.

4. Cable in accordance with claim 1 wherein the inner layer is glass/silicone/mica.

5. Cable in accordance with claim 1, wherein the inner layer is glass fibers and/or ceramic fibers.

6. Cable in accordance with claim 1, wherein the conductor cores in the stranded elements and the stranded elements themselves are stranded with complete backtwist.

7. Cable in accordance with claim 1, wherein the metal strip of the sheath runs in longitudinally and is wrapped around the cable core with overlapping edges.

8. Cable in accordance with claim 1, wherein armor is applied over the sheath.

9. Cable in accordance with claim 8, wherein the armor is two steel strips, one above the other, each of which is wound with gaps, wherein the gaps of each strip are covered by the other steel strip.

* * * * *